United States Patent [19]

Rayfiel

[11] Patent Number: 4,732,386

[45] Date of Patent: Mar. 22, 1988

[54] VISIBLE RANDOMLY INTERMESHING, MULTI-WHEEL CHANCE GAME APPARATUS

[76] Inventor: Howard Rayfiel, R.D. 2 - Box 118-B, Corinth, N.Y. 12822

[21] Appl. No.: 831,470

[22] Filed: Feb. 19, 1986

[51] Int. Cl.[4] ..... A63B 71/04

[52] U.S. Cl. ..... 273/142 H; 273/138 A

[58] Field of Search ..... 273/138 A, 143 R, 142 R, 273/142 H, 142 HA, 142 J, 142 JA, 142 JB, 142 JC, 142 JD

[56] References Cited

U.S. PATENT DOCUMENTS

| | | | |
|---|---|---|---|
| 749,698 | 1/1904 | Molitor | 273/142 H |
| 2,520,235 | 8/1950 | Bybee | 273/142 |
| 3,243,185 | 3/1966 | Miller | 273/142 |
| 3,355,172 | 11/1967 | Aukens | 273/142 H |
| 3,441,281 | 4/1969 | Pannwitz | 273/142 |
| 3,751,040 | 8/1973 | Carey | 273/143 R |
| 3,759,524 | 9/1973 | McNaney | 273/142 A |
| 4,291,881 | 9/1981 | Klamer | 273/142 H |
| 4,618,150 | 10/1986 | Kimura | 273/143 R |

*Primary Examiner*—Richard C. Pinkham
*Assistant Examiner*—MaryAnn Stoll Lastova
*Attorney, Agent, or Firm*—Price, Gess & Ubell

[57] ABSTRACT

A chance game apparatus having five secondary wheels positioned outside of and along the circumferential edge of a primary wheel. Each wheel has a sequence of winning and losing indices with each sequence different from one another. Each sequence defines a different probability of a random selection of one index resulting in a winning index. A winning situation is created by matching a winning index on a secondary wheel with a winning index on the primary wheel.

17 Claims, 6 Drawing Figures

VISIBLE RANDOMLY INTERMESHING, MULTI-WHEEL CHANCE GAME APPARATUS

BACKGROUND OF THE INVENTION

1. Field of the Invention

This invention relates generally to games of chance and, in particular, to a game of chance that requires the matching of winning indices from various sequences of indices.

2. Brief Description of the Prior Art

Numerous games of chance have been in existence for years. Those games have included various apparatus designs to create probabilities of certain events occurring. For example, Miller, "Chance Device with Sequentially Indexing Rotatable Discs," U.S. Pat. No. 3,243,185 describes an apparatus used for randomly selecting numbers in a game of Bingo. The utility of Miller is limited inasmuch as it only randomly selects numbers without repeating any number and requires an added device, such as a playing card having some of the numbers which can be randomly selected, which provides a means for determining a winning situation. McNaney, "Game of Chance Apparatus," U.S. Pat. No. 3,759,524 describes a game for selecting numbers similar to the game of dice. Magnets and illumination means combine to provide an apparatus for randomly selecting and showing numbers represented by various light patterns, particularly like those in dice.

Of similar utility are Klamer, "Kaleidoscopic Game Device," U.S. Pat. No. 4,291,881 and Bybee, "Rotating Disk Game," U.S. Pat. No. 2,520,235.

Some of the shortcomings in the games of chance in the prior art include the lack of visual stimulation, predetermined probabilities of winning, and different levels and possibilities of winning. Further, what is needed is a game that allows several people to play at any one time, and the possibility for a group of players to play against one player.

SUMMARY OF THE INVENTION

One object of the present invention is to provide a game that is visually stimulating through the use of colors or lights, or a combination thereof, which are seen in sequences that move or appear to move.

Another object of the present invention is to provide a game of chance which has differing levels of play and each level of play has a predictable probability of producing a winning situation.

A further object of the present invention is to provide a game in which several players can play at one time.

A preferred embodiment of the present invention accomplishes these objects by providing a primary element having a sequence of indices that include winning indices, a plurality of secondary elements each having a sequence of indices that include winning indices, the sequences each being different from one another, means for randomly selecting a plurality of indices on the primary element, the number so selected being equal to the number of secondary elements, and means for selecting one index in each sequence on the secondary elements.

These and other objects of the present invention will be evident and best understood from the following description when examined in light of the drawings herein.

DETAILED DESCRIPTION OF THE PREFERRED EMBODIMENTS

Figure 1:
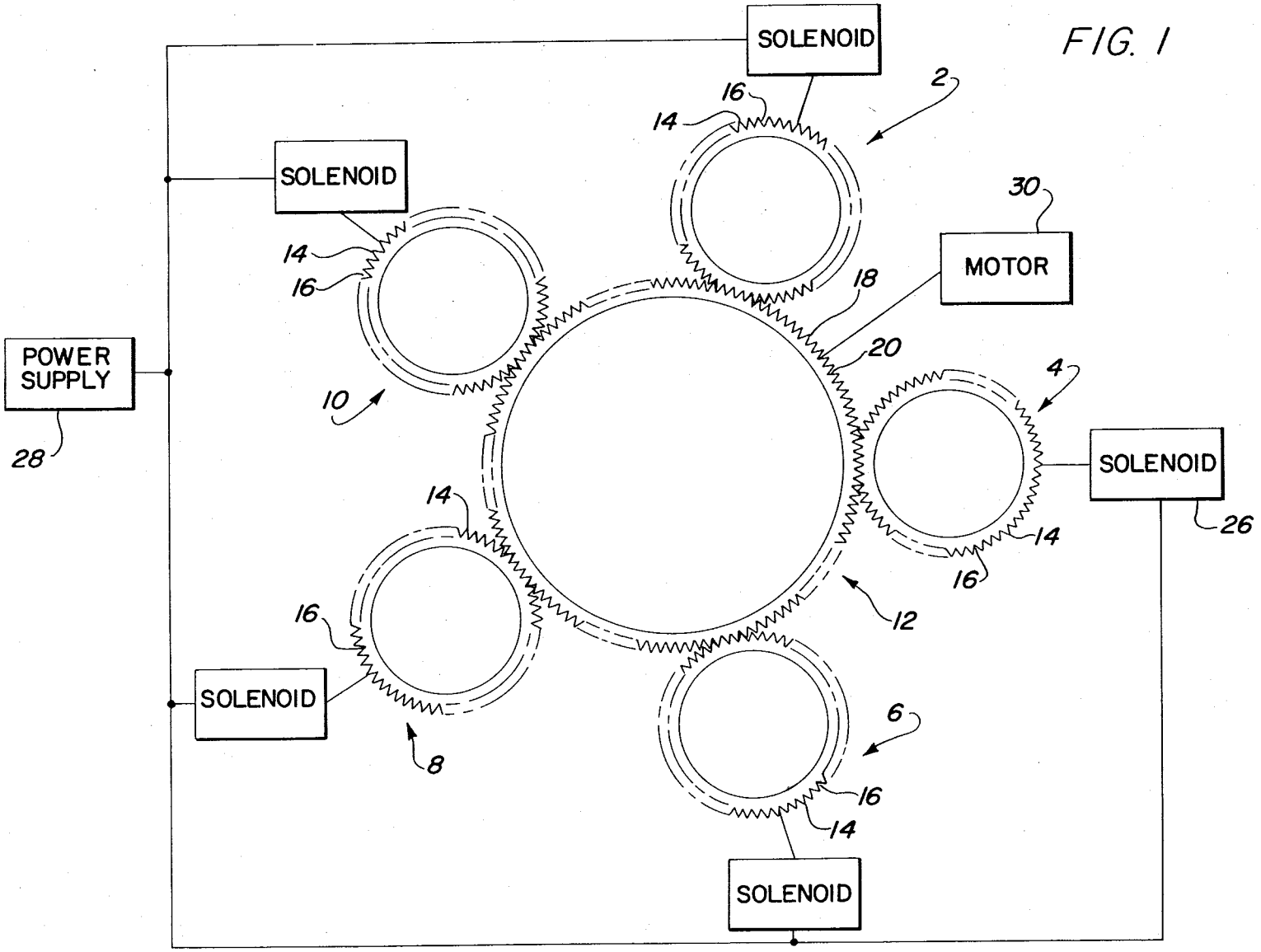
FIG. 1 is a diagramatical top view of a first preferred embodiment of the invention.
Figure 2:
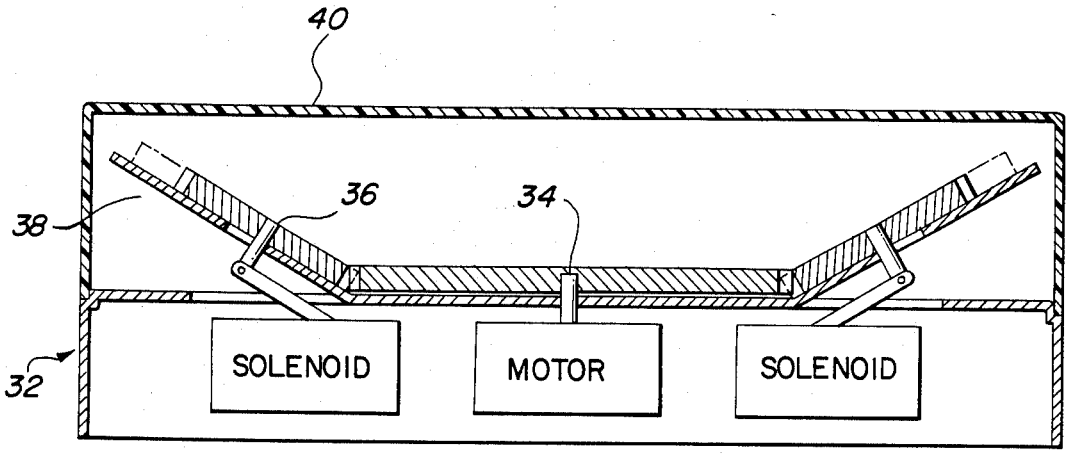
FIG. 2 is a side, elevation view of the first embodiment of the invention.
Figure 3:
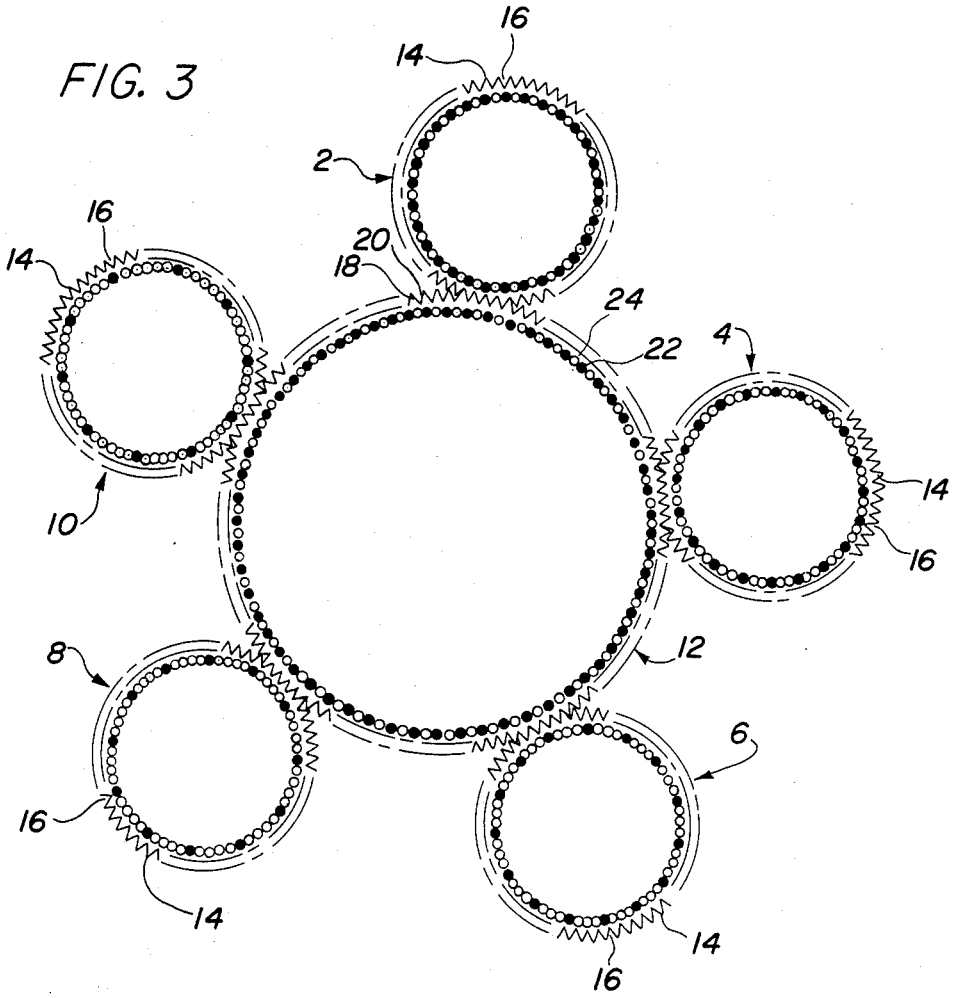
FIG. 3 is a partial, top view of the primary wheel and secondary wheels having various winning sequences, as found in the first and second preferred embodiments of the invention.

FIG. 1 depicts in diagramatical form a first preferred embodiment of the present invention. A primary wheel 12 is rotatably disposed on a primary axis 34 and has along its entire circumferential edge a plurality of alternating teeth 18 and notches 20 as shown in FIGS. 1 and 2. While other configurations and dimensions are contemplated in the present invention, in the preferred embodiment, primary wheel 18 is nineteen inches in diameter and has one hundred twenty teeth 18 and one hundred twenty notches 20. Each tooth 18 is generally triangular in shape and is one-half inch long on each side. As shown in FIG. 3, a sequence of winning indices 22 and losing indices 24 are located about the circumferential edge of primary wheel 12. While any distinguishing indices would be appropriate, such as colors, in FIG. 3, a winning index 22 is depicted by a blackened circle. A losing index 24 is depicted by an open circle. A winning index 22 or a losing index 24 is immediately opposite the apex of each tooth 18 and sequentially arranged to provide a particular probability of a winning index 22 being selected in a random fashion, as will be later described. Consequently, it is contemplated in the present invention, that the ratio of winning indices 22 to losing indices 24 can be appropriately changed to change the probability of a winning index 22 occurring, as further described below.

Figure 5:
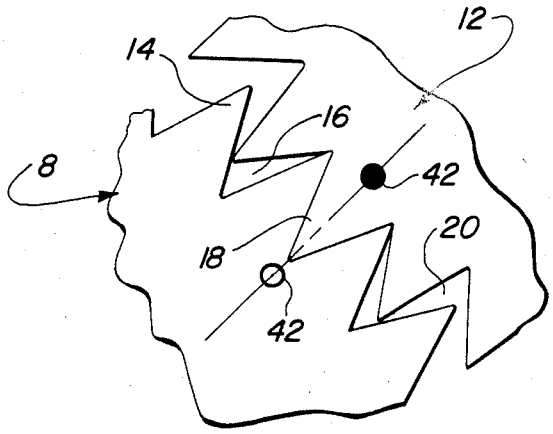
FIG. 5 is a partial exploded view of FIG. 3.

Secondary wheels 2, 4, 6, 8, 10 are rotatably disposed on five secondary axes 36 and positioned along and immediately outside of the circumferential edge of primary wheel 12, as can be seen in FIGS. 1 and 2. For ease of ascertaining the probability of a winning situation occurring, as further described below, secondary wheels 2, 4, 6, 8, 10 are equidistant to one another circumferentially about primary wheel 12. In the preferred embodiment, secondary wheels 2, 4, 6, 8, 10 are of a diameter one-half that of primary wheel 12 and have along their entire circumferential edges alternating teeth 14 and notches 16 similar to that on primary wheel 12. Each tooth 14 and notch 16 is configured and dimensioned in the same manner as teeth 18 and notches 20 of primary wheel 12 to thereby allow teeth 14 and notches 16 to mesh in notches 20 and teeth 18. As shown in FIG. 5, at any one time, only one notch 16 of each secondary wheel 2, 4, 6, 8, 10 is engaged to a respective tooth 18 of primary wheel 12. Immediately adjacent each notch 16 is either a winning index 22 or losing index 24 to thereby form a sequence of winning indices 22 on each secondary wheel 2, 4, 6, 8, 10. Consequently, either a winnng index 22 or a losing index 24 on each notch 16 which is engaged with respective teeth 18 can be immediately opposite either a winning index 22 or a losing index 24 located on such teeth 18. As further described below, the situation of a winning index 22 on a notch 16 which is immediately opposite a winning index 22 on a tooth 18 determines a winning situation.

Although other sequences could be appropriate, in the preferred embodiment, secondary wheel 2 has a sequence of winning indices described by having one winning index 22 followed by one losing index 24 and continuing in that sequence around all notches 16 of secondary wheel 2, as in FIG. 3. Secondary wheel 4 has a sequence of winning indices described by one winning index 22 followed by two losing indices 24. The sequence of secondary wheel 6 is described by one winning index 22 followed by three losing indices 24. Secondary wheel 8 has a sequence defined by one winning index 22 followed by four losing indices 24. Secondary wheel 10 has a sequence defined by one winning index 22 followed by five losing indices 24. The result is that a random selection of a notch 16 on secondary wheel 2 will produce a winning index 22 50% of the time out of a number of random selections. For secondary wheels 4, 6, 8, 10, the probabilities of randomly selecting a notch 16 having a winning index 22 will be $33\frac{1}{3}$%, 25%, 20%, and $16\frac{2}{3}$%, respectively.

However, the particular winning sequence on primary wheel 12 affects the probabilities of a winning situation occurring since a winning index 22 on a notch 16 of any one of secondary wheels 2, 4, 6, 8, 10 must be immediately adjacent a winning index 22 on a tooth 18 of primary wheel 12. Therefore, as the ratio of winning indices 22 to losing indices 24 increases or decreases on primary wheel 12, the probability of randomly selecting a winning index 22 on primary wheel 12 together with randomly selecting a winning index 22 on any secondary wheel 2, 4, 6, 8, 10, increases or decreases, respectively. In the preferred embodiment, primary wheel 12 has a winning sequence described by one winning index 22 followed by one losing index 24. With such a sequence, the probability of a winning situation randomly occurring is at 25% (1 out of 4), $16\frac{2}{3}$% (1 out of 6), $12\frac{1}{2}$% (1 out of 8), 10% (1 out of 10), and $8\frac{1}{3}$% (1 out of 12), respectively, for secondary wheels 2, 4, 6, 8, 10. By the substitution of five losing indices 24 to the sequence on primary wheel 12 and each losing index 24 of the group is placed 72° apart, the probability of a winning situation occurring is reduced by $8\frac{1}{3}$% with respect to each secondary wheel, 2, 4, 6, 8, 10. Similarily, substituting a group of five winning indices 22 increases the probability of a winning situation occurring by $8\frac{1}{3}$%.

In view of the above, the present invention contemplates the utilization of more or less than five secondary wheels 2, 4, 6, 8, 10 and sequences different than those described above. Providing different sequences among secondary wheels 2, 4, 6, 8, 10 provides different levels of play. Similarly, providing more secondary wheels 2, 4, 6, 8, 10 provides a greater number of levels of play.

Referring to FIG. 2, a base 32 having a flat planar element is provided to support primary wheel 12 and secondary wheels 2, 4, 6, 8, 10. Also supported by base 32 are five tracks 38 which support and hold secondary wheels 2, 4, 6, 8, 10 and permit their rotation in tracks 38 about secondary axes 36. Each track 38 is angularly disposed to the planar element of base 32. Above base 32 and tracks 38 is a cover 40 having a planar element parallel to the planar element of base 32. Cover 40 is made of a transparent material, like Lucite.

A motor 30 rotates primary wheel 12 about primary axis 34. As a result of the engagement of teeth 14 and notches 16 of secondary wheels 2, 4, 6, 8, 10 with notches 20 and teeth 18 of primary wheel 12, the rotation of primary wheel 12 is imparted to secondary wheels 2, 4, 6, 8, 10. As such rotation continues, five solenoids 26 are activated to displace secondary wheels 2, 4, 6, 8, 10 away from primary wheel 12 and along tracks 38. Upon their disengagement, secondary wheels 2, 4, 6, 8, 10 continue to freely rotate. In the preferred embodiment, secondary wheels 2, 4, 6, 8, 10 are of a different weight than one another; consequently, following their free rotation, each rotates at different decreasing rates and thus re-engage primary wheel 12 at different times. One purpose of having each secondary wheel 2, 4, 6, 8, 10 rotate independently of one another and independently of primary wheel 12 is to provide a means for randomly selecting a notch 16 on each secondary wheel 2, 4, 6, 8, 10 and five teeth 18 on primary wheel 12.

When secondary wheels 2, 4, 6, 8, 10 re-engage primary wheel 12, a tooth 18 of primary wheel 12 will be disposed in a notch 16 of each secondary wheel 2, 4, 6, 8, 10. As already noted above, a winning situation occurs by having a winning index 22 on a notch 16 immediately opposite a winning index 22 on a tooth 18. Any other combination of indices results in a losing situation.

Figure 4:
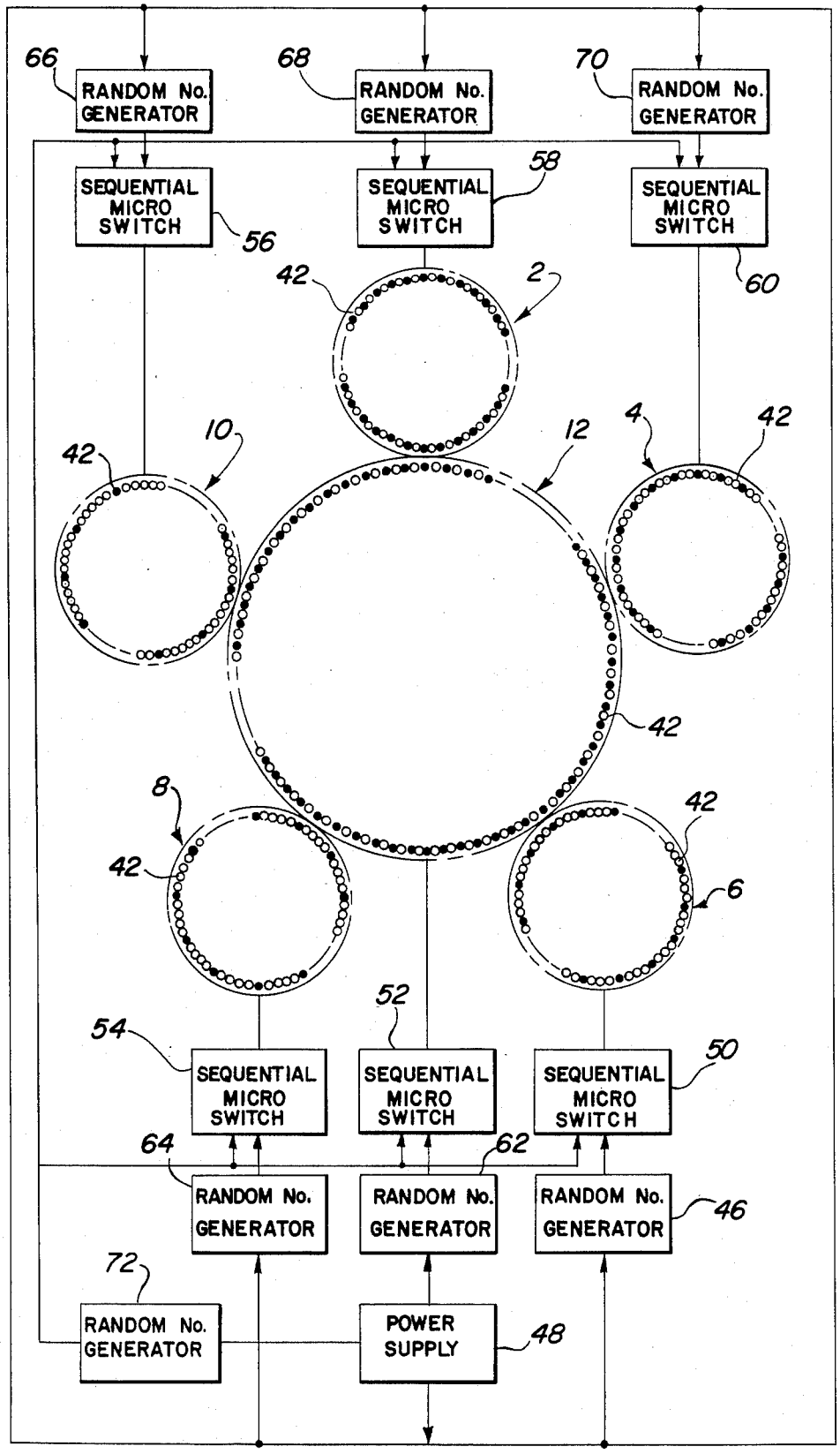
FIG. 4 is a diagramatical top view of the second preferred embodiment of the invention.

In a second preferred embodiment (FIG. 4), primary wheel 12 is provided with secondary wheels 2, 4, 6, 8, 10 outside of and along its circumferential edge. Instead of alternating teeth 18 and notches 20 disposed along the entire circumferential edge of the primary wheel 12, and alternating teeth 14 and notches 16 disposed along the circumferential edges of each secondary wheel 2, 4, 6, 8, 10, this embodiment contemplates the use of lights in each of the primary wheel 12 and secondary wheels 2, 4, 6, 8, 10, as shown in FIG. 4. Further, it is contemplated that configurations other than circular wheels could be used.

Figure 6:
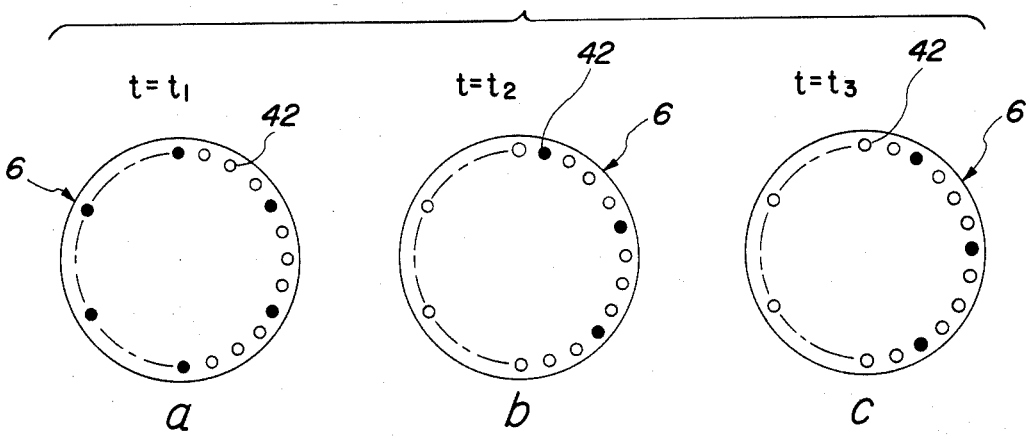
FIG. 6*a, b,* and *c* is a partial view of a secondary wheel when illuminated over a period of time.

Instead of winning index 22 and losing index 24 which define sequences on primary wheel 12 and secondary wheels 2, 4, 6, 8, 10 in the first embodiment, in the second preferred embodiment (FIG. 4), a plurality of lights 42 are disposed as if to be immediately adjacent to each tooth 18 of primary wheel 12 and each notch 16 on secondary wheels 2, 4, 6, 8, 10. Each light 42 can be illuminated or remain dark through activation of five sequential microprocessor switches 50, 52, 54, 56, 58, 60 connected to secondary wheels 2, 4, 6, 8, 10. Sequential microprocessor switches 50, 52, 54, 56, 58, 60 activate the respective lights 42 to each secondary wheel 2, 4, 6, 8, 10 independently of one another. In this preferred embodiment, sequential microprocessor switch 50 can illuminate lights 42 on secondary wheel 6 in a sequence defined by a light 42 being illuminated followed by three lights 42 being dark and continuing through lights 42 until sequential microprocessor switch 50 is deactivated. Sequential microprocessor switch 54 sequences lights 42 on secondary wheel 8 by illuminating one light 42 and leaving the next four lights 42 dark. Sequential microprocessor switch 56 sequences lights 42 on secondary wheel 10 by illuminating one light 42 and leaving the next five lights 42 dark. Sequential microprocessor 58 switch sequences lights 42 on secondary wheel 2 by illuminating every other light 42. Sequential microprocessor switch 60 sequences lights 42 on secondary wheel 4 by illuminating one light 42 and leaving the next two lights 42 dark. Finally, sequential microprocessor switch 62 sequences lights 42 of primary wheel 12 in a sequence that can vary, as described above in the first preferred embodiment. The result of the sequential activation of lights 42 has a visual effect similar to that of marquee lights moving around in a circle. FIGS. 6*a, b, c* depict an example of this marque effect by secondary wheel 6 being sequentially illuminated at periods of time $t_1$, $t_2$, and $t_3$.

Six random number generators 46, 62, 64, 66, 68, 70 are independently connected to respective sequential microprocessor switches 50, 52, 54, 56, 58, 60. Upon activation of a power supply 48, each random number generator 46, 62, 64, 66, 68, 70 randomly selects within predetermined limits a rate at which it causes its respective sequential microprocessor switch 50, 52, 54, 56, 58, 60 to sequentially activate the respective lights 42 which they control. The sequential activiation of the lights 42 on each wheel creates an apparent movement of the activiated lights 42 around the circumferences of the respective wheels. The random rate of such activation varies from wheel to wheel within predetermined limits, ideally from 1/5 of a second to ½ of a second. In FIGS. 3 and 4, an illuminated light 42 is depicted by a blackened circle.

A random generator 72 is also provided to control randomly the duration of time that the lights 42 on all wheels are sequentially activated upon each play of the game. FIG. 4 shows random generator 72 connected to power supply 48 and each of the sequential microprocessor switches 50, 52, 54, 56, 58, 60. Through conventional means not shown, upon each play of the game, random number generator 72 is activated and randomly selects (within predetermined limits) the duration of time during which the sequential activation occurs. Preferably, random number generator 72 randomly selects the duration of each game between ten and twenty seconds. Random number generator 72 thereby provides an added dimension of randomness to the game and is preferably activated by an on-off switch in the power supply (not shown). As can be appreciated, instead of a single random generator 72, multiple random generators can be utilized to individually control the duration of activation on each wheel and thereby add to the randomness.

At the random point in time when the period of activation of the lights 42 ends, every second light on the primary wheel 12 and every second, third, fourth, fifth and sixth light on, respectively, secondary wheels 2, 4, 6, 8, and 10, will remain illuminated. Each light 42 will thereafter continue in the same state (illuminated or not illuminated) until the next play of the game is commenced.

And as in the first embodiment above, a winning situation is indicated by a light 42 being illuminated on a secondary wheel 2, 4, 6, 8, 10 which is immediately opposite an illuminated light 42 on primary wheel 12. All other combinations are losing situations.

It is understood, of course, that the above specification describes only two preferred embodiments of the present invention, and that appropriate modifications may be made which are nevertheless within the spirit and scope of the present invention as more fully described in the following claims, wherein:

I claim:

1. A chance game apparatus, comprising:

a primary element having a primary sequence of primary winning indices and primary losing indices, the primary element being so positioned in the apparatus to enable all players to view all of the primary winning indices and the primary losing indices at all times during a play of the game;

a plurality of secondary elements each having a secondary sequence of secondary winning indices and secondary losing indices, the secondary sequences being different from each other and from the primary sequence and further providing a statistically calculable chance of providing a win situation, the secondary elements being so positioned in the apparatus as to enable all players to concurrently pick at least one secondary element for a play of the game and to view all of the secondary winning indices and the secondary losing indices at all times during a play of the game, the secondary elements being further positioned as to operatively place the primary winning and primary losing indices adjacent the secondary winning and secondary loosing indices;

means for randomly selecting a plurality of indices in the primary sequence on the primary element while preventing a player from interceding and affecting the randomness of the selection;

means for randomly selecting one index in each of the secondary sequences on the secondary elements while preventing a player from interceding and affecting the randomness of the selection, such selection on the secondary sequences occurring during the selection on the primary sequence, whereby a win situation is indicated only if adjacent selected indices on the primary element and on a secondary element both happen to be winning indices.

2. The invention of claim 1 further comprising means for randomly selecting a plurality of indices on the primary element, the number so selected being equal to the number of secondary elements.

3. The invention of claim 2 further comprising means for pairing the selected index on each secondary element to the selected indices on the primary element, each selected index on the primary element being associated with only one secondary element.

4. The invention of claim 3 wherein one of a win situation and a loss situation is associated with each secondary element.

5. The invention of claim 1 wherein the selection on the primary sequence occurs over a first period of time and the selection on the secondary sequences occurs over at least one second period of time that is different from the first period of time.

6. The invention of claim 5 wherein there are a plurality of second periods of time, each of which is different from one another.

7. The invention of claim 1 wherein the number of primary losing indices exceeds the number of primary winning indices.

8. A chance game apparatus, comprising:

a primary wheel having a top side extending in a first plane, a circumferential edge, and a plurality of alternating primary teeth and primary notches along the circumferential edge, at least one of the primary teeth and the primary notches having a primary winning index and at least one of the other primary teeth and primary notches having a primary losing index, all the primary winning and primary losing indices in the aggregate defining a primary sequence, the entire primary sequence being subject to view by all players at all times during a play of the game;

a plurality of secondary wheels, each secondary wheel being positioned outside of and along the circumferential edge of the primary wheel and having a top side extending in a respective second plane, each second plane being angulated with respect to the first plane, and a plurality of alternating secondary teeth and secondary notches, the number of secondary teeth and secondary notches on each respective secondary wheel being less than the number of primary teeth and primary notches, a secondary notch of each secondary wheel being meshed with primary teeth of the primary wheel, at least one of the secondary notches and secondary teeth of each secondary wheel having a winning index, and at least one of the other secondary notches and secondary teeth on each secondary wheel having a losing index which, in the aggregate define a respective secondary sequence, each secondary sequence being different from one another and from the primary sequence to thereby provide a statistically calculable chance of providing a win situation, each entire secondary sequence being subject to view by all players before and at all times during a play of the game and each secondary wheel being so positioned to enable a plurality of players each to select a secondary wheel prior to a play of the game;

means for rotating the primary wheel and thereby the secondary wheels; and means for disengaging the secondary wheels from the primary wheel, then allowing the secondary wheels to continue to randomly rotate for period of time in the second planes while preventing a player from interceding and affecting the randomness of rotations, such rotations continuing in the second planes until forces of gravity and friction cause the secondary wheels to move towards the primary wheel, and then re-engage with the primary wheel so that secondary notches and secondary teeth of the secondary wheels are meshed with the primary teeth and primary notches of the primary wheel; whereby one of a win situation and a loss situation is created with respect to each secondary wheel, and a win situation is denoted by an immediately adjacent primary winning index and secondary winning index.

9. The invention of claim 8 wherein the number of secondary teeth on each secondary wheel is one-half the number of primary teeth.

10. The invention of claim 9 wherein each secondary tooth and secondary notch is configured and dimensioned like each primary tooth and primary notch, respectively.

11. The invention of claim 10 wherein the secondary wheels are equidistant around the circumferential edge of the primary wheel.

12. The invention of claim 11 wherein the number of secondary losing indices on each secondary wheel is equal to or greater than the number of secondary winning indices on each respective secondary wheel.

13. A chance game apparatus, comprising:

a primary element having a sequence of indices, which includes winning indices, defined by a plurality of illumination means, each of which can be lighted at any point in time, with a winning index being defined by a light illumination means;

a plurality of secondary elements, each having a sequence of indices, which includes winning indices, defined by a plurality of illumination means, each of which can be lighted at any point in time, with a winning index being defined by a light illumination means;

means for sequentially activating for a first period of time the illumination means of the primary element;

means for sequentially activating for a second period of time the illumination means of each secondary element;

means for randomly controlling the sequential rate of activation of the illumination means of the primary element independently of the rates of activation of the illumination means of the secondary elements;

means for randomly controlling the sequential rate of activation of the illumination means of each secondary element;

means for selecting a plurality of illumination means on the primary element following its sequential activiation for the first period of time, the number selected being equal to the number of secondary elements;

means for selecting one of the illumination means on each of the secondary elements following their sequential activation for the second period of time; and means for pairing the selected illumination means on each secondary element to the selected illumination means on the primary element, each selected illumination means on the primary element being associated with only one secondary element whereby when the paired illumination means are lighted, a win situation is indicated.

14. The invention of claim 13 further comprising means for randomly selecting the first period of time and second period of time.

15. The invention of claim 13 wherein the first period of time is different from the second period time.

16. The invention of claim 13 or 15 wherein the second period of time with respect to each secondary element is different from one another.

17. The invention of claim 13 wherein the means for randomly controlling the sequential rate of activation of each secondary element is independent of each other secondary element.

* * * * *